US008122561B2

(12) United States Patent
Dingert et al.

(10) Patent No.: US 8,122,561 B2
(45) Date of Patent: Feb. 28, 2012

(54) WRINGER

(75) Inventors: Uwe Dingert, Abtsteinach (DE); Leif Kniese, Berlin (DE); Rudolf Bannasch, Berlin (DE)

(73) Assignee: Carl Freudenberg KG, Weinheim (DE)

( * ) Notice: Subject to any disclaimer, the term of this patent is extended or adjusted under 35 U.S.C. 154(b) by 429 days.

(21) Appl. No.: 12/442,683

(22) PCT Filed: Sep. 14, 2007

(86) PCT No.: PCT/EP2007/008017

§ 371 (c)(1),
(2), (4) Date: Mar. 24, 2009

(87) PCT Pub. No.: WO2008/037361

PCT Pub. Date: Apr. 3, 2008

(65) Prior Publication Data

US 2009/0288266 A1 Nov. 26, 2009

(30) Foreign Application Priority Data

Sep. 25, 2006 (DE) ..... 10 2006 045 615

(51) Int. Cl.
*A47L 13/58* (2006.01)

(52) U.S. Cl. ..... 15/260; 15/263; 68/241; 68/242; 68/243; 100/110; 100/132

(58) Field of Classification Search ..... 15/260, 15/263; 68/241–243; 100/104, 110, 126, 100/131, 132, 213; 206/361, 15.2, 15.3, 206/209; 220/646, 666, 676
See application file for complete search history.

(56) References Cited

U.S. PATENT DOCUMENTS

| | | | | |
|---|---|---|---|---|
| 3,406,422 | A | 10/1968 | Nichols | |
| 5,611,104 | A * | 3/1997 | DeMars | 15/263 |
| 2002/0095739 | A1 | 7/2002 | Dingert | |
| 2007/0094834 | A1 * | 5/2007 | Gil | 15/261 |

FOREIGN PATENT DOCUMENTS

| | | | |
|---|---|---|---|
| EP | 0489237 | A | 10/1992 |
| EP | 1224901 | A2 | 7/2002 |

* cited by examiner

*Primary Examiner* — Mark Spisich
(74) *Attorney, Agent, or Firm* — Leydig, Voit & Mayer, Ltd.

(57) ABSTRACT

A wringer (1) for a mop (2) with a receptacle (3) in which the mop (2) can be wrung out by inward pressure, where the receptacle (3) consists of a number of wall parts (4), each of which has an inner leg (5) and an outer leg (6), which are connected together, where spacers (7) are arranged between the inner legs (5) and outer legs (6).

19 Claims, 8 Drawing Sheets

WRINGER

BRIEF DESCRIPTION OF THE TECHNICAL FIELD

The invention concerns a wringer for a mop with a receptacle in which the mop can be wrung out by pressure, where the receptacle has a number of wall parts, each of which has an inner leg and an outer leg, which are connected together.

BACKGROUND OF THE INVENTION

Wringers of this kind are known from EP 0 489 237 A1. The wringer shown there has a receptacle that has wall parts formed of a number of V-shaped wall parts, where the outer legs are fixed in position on the receptacle and the inner legs are connected together at their free ends. When a mop is pressed in, the connected free ends of the inner legs move downward, which causes the wall parts to deform, so that the free clearance of the receptacle is reduced and in this way the mop is additionally pressed at the sides.

BRIEF SUMMARY OF THE INVENTION

A general object of the invention is providing available a wringer for a mop that has an improved wringing power with simple operation.

To this end, at least one spacer is arranged between the inner legs and outer legs. The inner and outer legs, moreover, are connected together at their free ends; the inner and outer legs are designed in accordance with the invention to be elastic and the spacer is designed to be stable in tension or under pressure in order to be able to transfer forces from the inner leg to the outer leg. When a mop is pressed into the receptacle, the inner leg gives and, in doing so, becomes elastically deformed. The deflection of the inner leg is transferred through the minimum of one spacer to the outer leg due to the connection between the inner and outer legs. The outer leg acts as a compressive and elastic bending rod. When a force is applied to the inner leg, the inner leg exerts a tensile force on the end of the outer leg, which stretches the outer leg and bends it in an arc. The outer leg produces a counterforce to the tensile force, and the outer leg is subject to a compressive bending stress. The outer leg is preferably designed so that, as it deforms as a result of the tensile force of the inner leg, the curve is convex. The minimum of one spacer keeps the middle part of the outer leg farther from the inner leg than is given by the length of the spacer so that the middle part of the outer leg cannot move outward. This brings about an arc-shaped bending of the outer leg, and the end of the outer leg moves inward, in the direction of the central axis of the wringer device, and surrounds and holds the mop. In doing so, the outer leg carries the free end of the inner leg with it so that the inner leg presses with all of its surface against the mop and surrounds it like a compressive band. The flow of forces in the wringer in accordance with the invention thus produces a mechanically coupled motion: the stronger the inward pressure of the mop into the receptacle, the greater the tensile force on the connection of the inner and outer legs will be and, accordingly, the greater the elastic compressive bending deformation of the outer leg will be, which is converted by the minimum of one spacer into an inward motion of the connection in the direction toward the mop. Because of this, the space available for the mop in the receptacle becomes smaller. The mop is pressed together on all sides at the same time. The more force with which the mop is pressed into the receptacle, the narrower and more tightly the device closes. This improves the wringer performance. The minimum of one spacer prevents bending of the outer leg, so that the outer leg accepts greater forces and, while having the same level of shatterproofness, can be made thinner and more flexible. This allows a savings of material and improves the wringer performance, as the same wringer performance can be achieved with less force. Moreover, the spacer limits the vertical motion of the inner leg, and the diameter of the inner part of the receptacle becomes wider and higher as the outer leg bends convexly. In this way, the bucket can be made shallower or can be filled with more mop water. An embodiment with just one spacer can be produced especially simply and cheaply, and the spacer can be molded on the inner and outer leg in a single operation in an injection molding process.

The spacers can be hinged to the inner legs and outer legs. This improves the transfer of force from the inner to the outer leg, and the flexibility of the wringer.

The hinged connection of the spacers to the inner legs and outer legs can be made by means of film hinges. Film hinges have a simple design and therefore are easy to make. In addition, film hinges have only one degree of freedom, so that while they have high flexibility high stability of the wringer device is achieved at the same time.

At least the inner legs can be designed to be spiral-shaped. In view of the spiral shape, a simultaneous rotary motion of the inner legs takes place in addition to the inward motion when a mop is pressed into the recess. Through this, the strings of the mop becomes twisted, so that the wringer performance is improved still further.

The outer legs and inner legs can have a penetration in the transition region. This results in a savings of material and simplifies manufacture, since production tools can be inserted into the penetration.

The spacers can be arranged in the upper third of the outer leg. In this embodiment, there is only one spacer provided for each inner/outer leg pair. This results in ease of manufacturing while providing better performance.

The receptacle can consist of at least eight wall parts. This results in an easily produced and flexible receptacle, in which sliding of the mop strings past the receptacle is prevented.

The wall parts can be designed to be essentially v-shaped. In doing so, the inner legs can additionally be designed to be concave. Mops can easily be inserted into receptacles with such inner legs, and this results in high wringer performance.

A funnel can be attached to the receptacle. This simplifies the insertion of a string mop.

The receptacle can consist of a single material and be designed to be one piece. Such receptacles are easy and cheap to make.

The receptacle can consist of injected molded plastic. Receptacles of injected molded plastic are easy and cheap to make in high quantities.

BRIEF DESCRIPTION OF THE DRAWINGS

Some embodiment examples of the wringer in accordance with the invention are explained in more detail below by means of the figures. The figures show, in each case schematically.

DETAILED DESCRIPTION OF THE INVENTION

Figure 1:
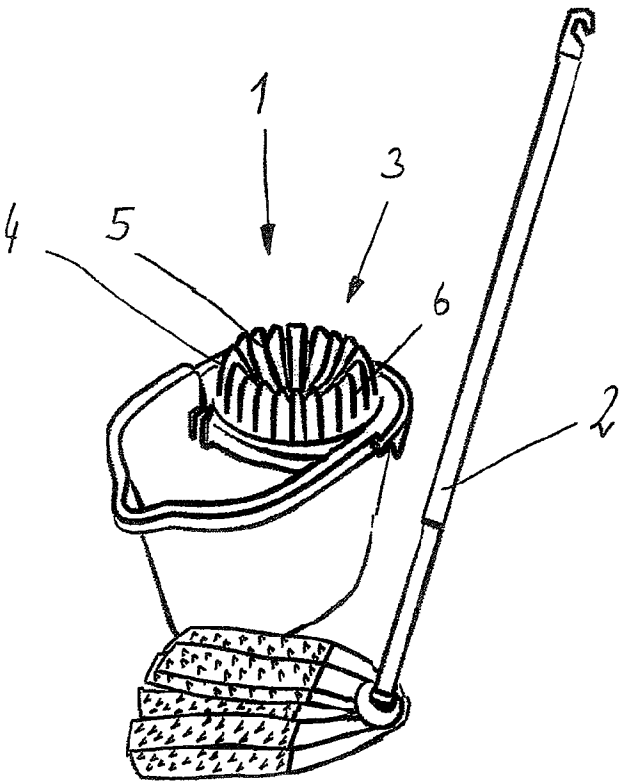
FIG. 1 is a perspective view of an illustrative wringer in accordance with the invention with a mop.

FIG. 1 shows a wringer 1 for mop 2, in particular a string mop, with a basket-like receptacle 3, in which the mop 2 can be wrung out by inward pressure. The receptacle 3 has eight wall parts 4, each of which consists of an inner leg 5 and an outer leg 6, which are connected together at their free ends.

Figure 2:
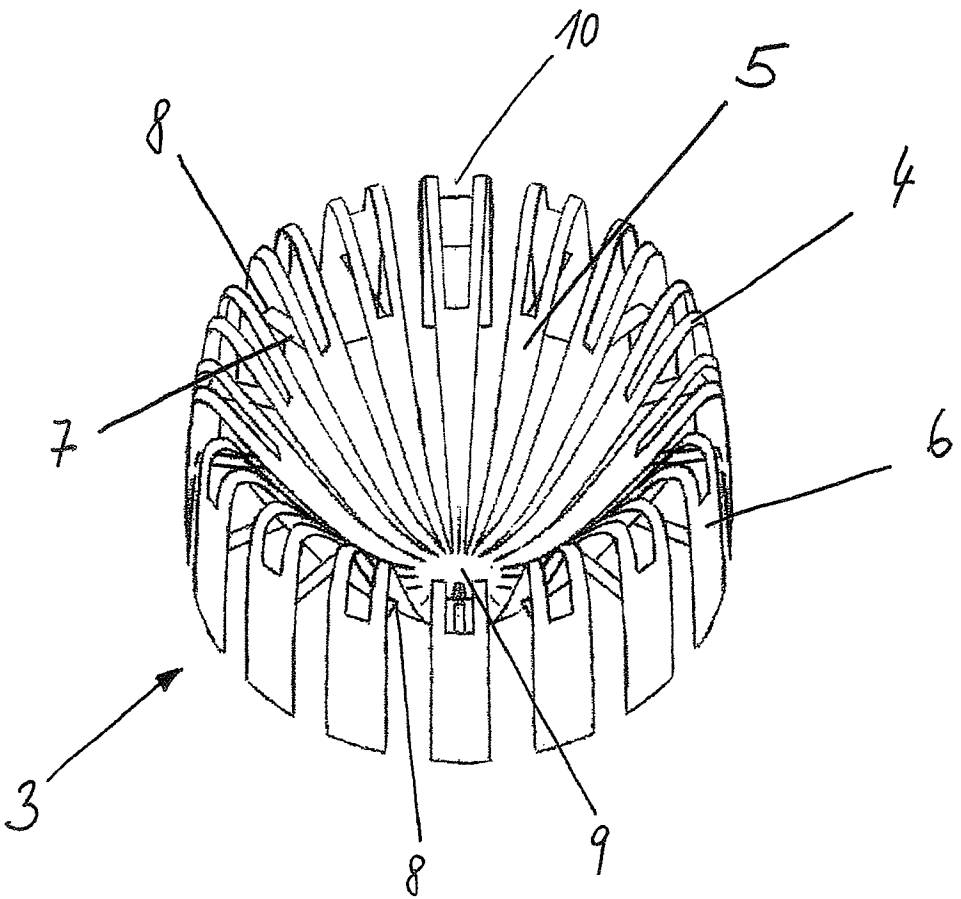
FIG. 2 is a perspective view of the receptacle of the wringer of FIG. 1 showing the receptacle with straight wall parts.

FIG. 2 shows in detail the receptacle 3 of wringer 1 as in FIG. 1. A spacer 7 is arranged between the inner leg 5 and outer leg 6 of each wall part 4 and is arranged in the upper third of the outer leg. The spacer 7 is made of the same material and is made in one piece with the inner leg 5 and outer leg 6. The connection of the spacer 7 to the inner leg 5 and outer leg 6 takes place by means of film hinges 8, so that a hinged connection results. The inner legs 5 are connected to each other at their free ends 9. The wall parts 4 are designed to be V-shaped and the inner legs 5 are designed and arranged in a spiral. The inner legs 5 and outer legs 6 have a penetration 10 in the transition region. The receptacle 3 has a circular cross section and consists of an injection molded plastic. The receptacle 3 can be removably arranged in a wringer 1. Receptacle 3 is secured in wringer 1 by a press fit connection.

Figure 3:
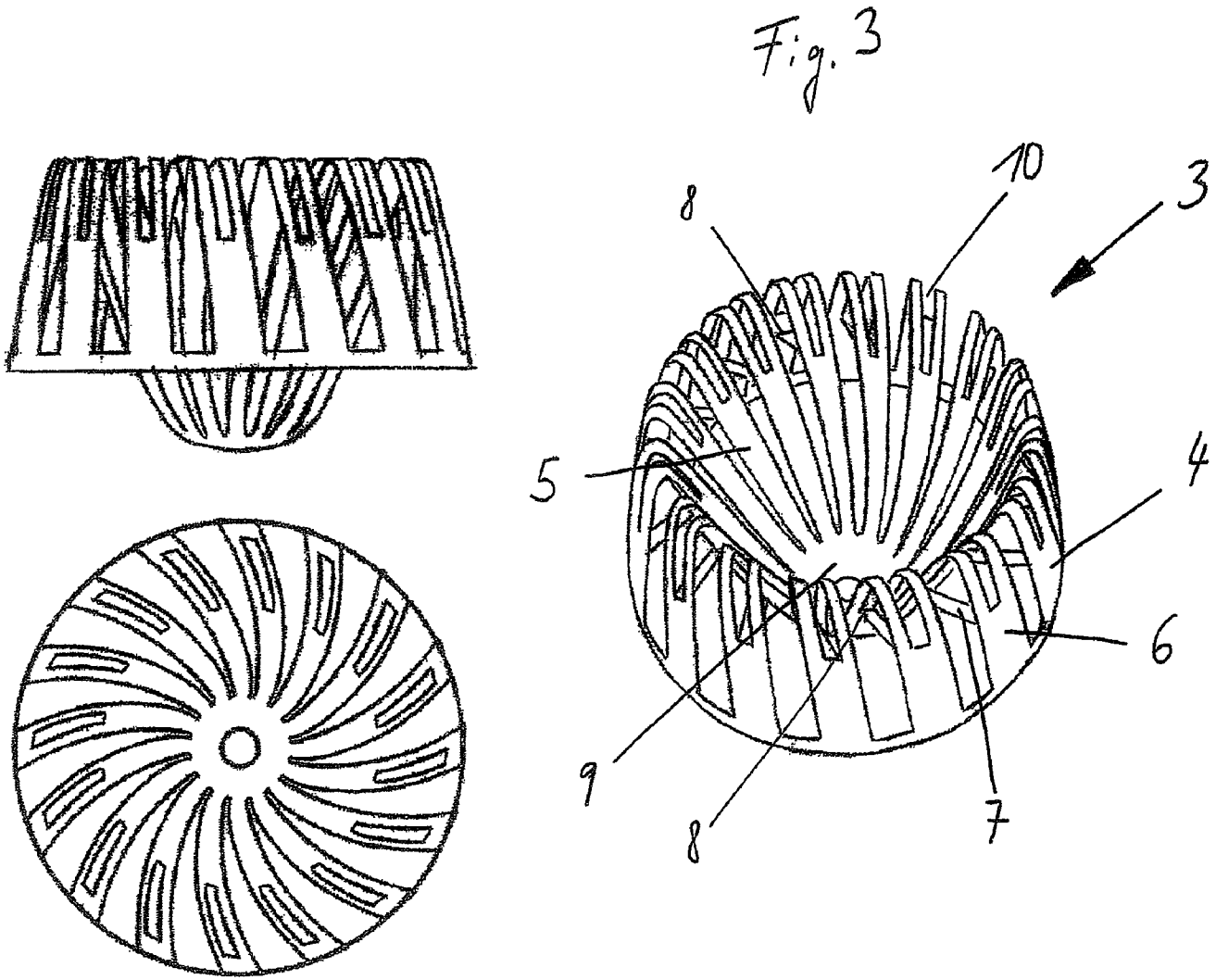
FIG. 3 includes top, side and perspective views of the receptacle of the wringer of FIG. 1 showing the receptacle with spiral-shaped wall parts.

FIG. 3 shows a receptacle 3 as in FIG. 2, where the inner legs 5 and the outer legs 6 of wall parts 4 are arranged in a spiral in this embodiment.

Figure 4:
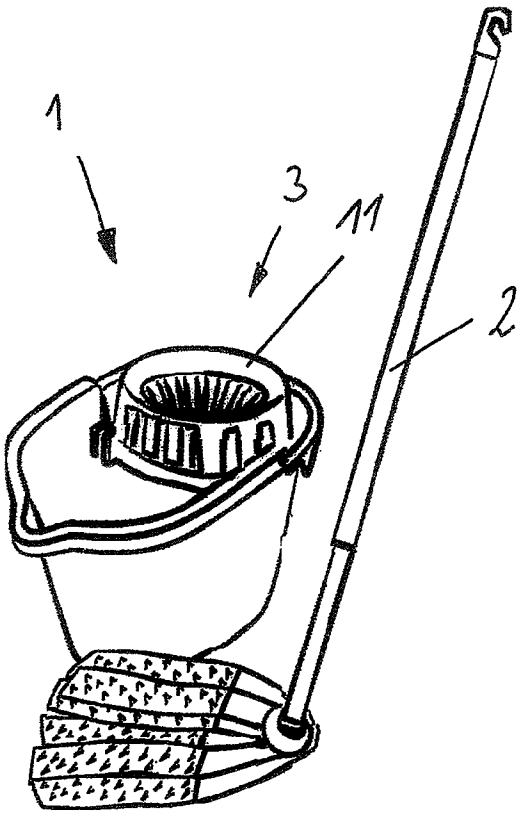
FIG. 4 is a perspective view of an alternative embodiment of a wringer according to the invention that includes a funnel.

FIG. 4 shows a wringer 1 with receptacle 3 as in FIG. 2 or 3. According to this embodiment, a funnel 11 is mounted on receptacle 3 and held on the receptacle by a press fit connection.

Figure 5:
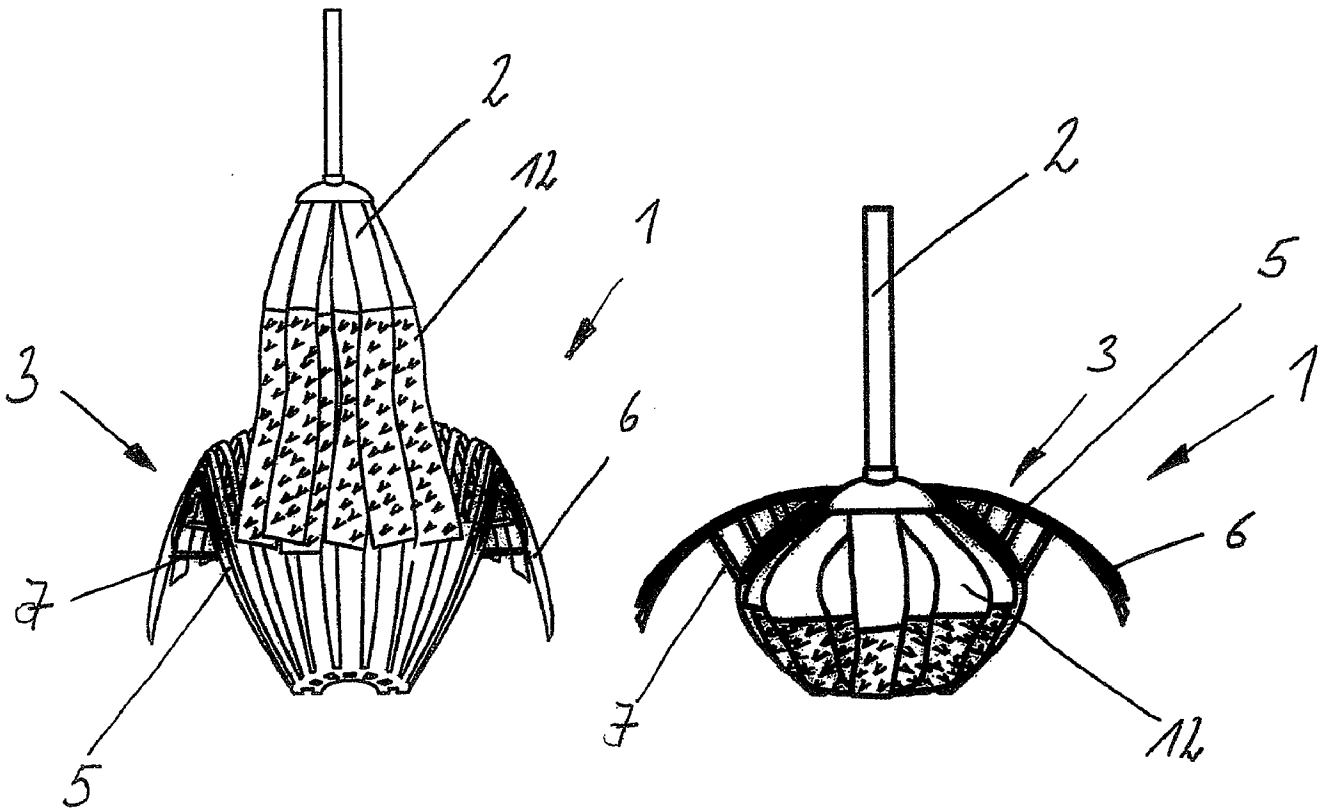
FIG. 5 includes side views showing a mop pressed into an illustrative wringer according to the invention.

FIG. 5 shows a wringing operation in a wringer 1 in accordance with the invention. Wringer 1 is especially suitable for mops 2 with strings 12, the strings 12 of which are held in a circular or ellipsoidal receptacle, and for flat mops, whose mop cover hangs from the mop plate in a loop for wringing out. For wringing out, the mop 2 is inserted into the receptacle 3, and the strings 12 are twisted into each other by rotation. The spiral-shaped inner legs 5 support this twisting, when the mop 2 is pressed into receptacle 3. When the mop 2 or the flat mop is pressed into receptacle 3, the inner legs 5 become deformed and a force is exerted on the inner legs 5. The deformation and the force is transferred through the spacers 7 to the outer legs 6 and they are likewise deformed. Since the inner legs 5 and outer legs 6 are connected together, the connecting points move in the direction toward the mop 2 due to the deformation of the inner legs 5 and outer legs 6. Through this the mop 2 is caught almost over its entire surface by the receptacle 3 and wrung out.

Figure 6:
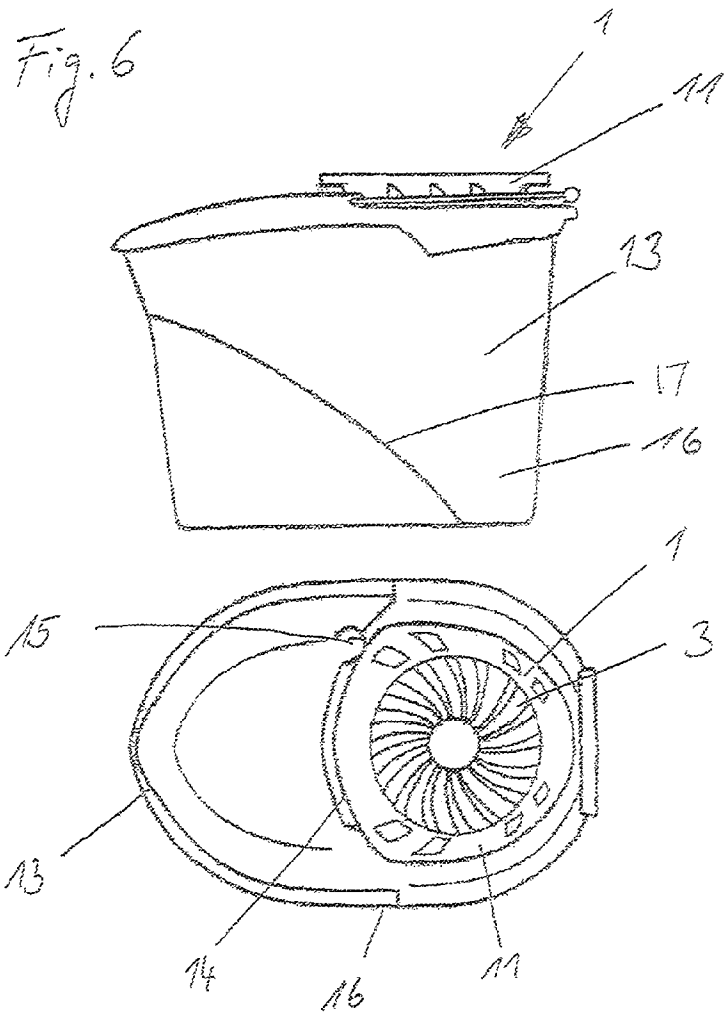
FIG. 6 includes top and side views of an exemplary bucket with a wringer in accordance with the invention.

FIG. 6 shows a bucket 13, on the edge of which a wringer 1 as in one of the preceding figures is affixed by means of a press fit connection. The wringer has a funnel 11, on which at the same time the fastening elements for fastening the wringer 1 on the bucket 13 are arranged and on which the receptacle 3 is affixed. The free edge 14 of funnel 11 is flattened out, so that funnel 11 has a triangular shape in a plan view. Through this the funnel 11 is arranged in the bucket in a space-saving way and produces a large free cross section through which the mop 2 can be immersed in the mop water in bucket 13. Moreover, funnel 11 has a receptacle 15, on which the handle of the mop 2 can be clipped. The bucket 13 has a basic oval shape and is provided with a crimp 17 on the longer sides 16. These crimps 17 stiffen the bucket 13 and allow a reduced wall thickness and thus the production of a light and cheap bucket 13.

Figure 7:
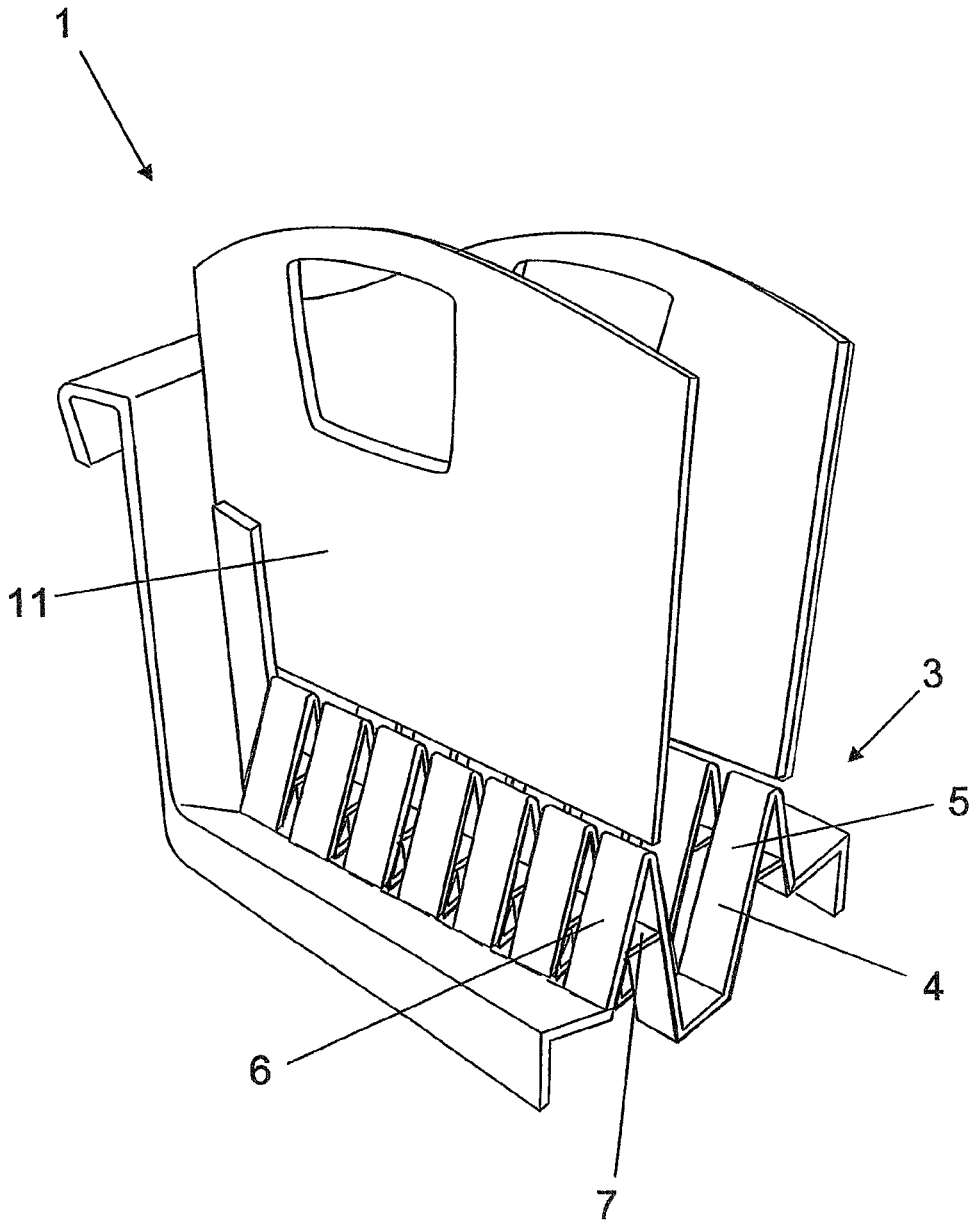
FIG. 7 is a perspective view of an alternative embodiment of a wringer in accordance with the invention for a flat mop.

FIG. 7 shows a wringer 1 for a flat mop with a mop cover that hangs from the folded mop plate in a loop for wringing out. The wringer includes a receptacle 3 in which the flat mop 2 can be wrung out by pressure. The receptacle 3 has a number of V-shaped wall parts 4, each of which consists of an inner leg 5 and an outer leg 6, which are connected together at their free ends. Here the wall parts 4 are arranged in two essentially straight rows, where in each case two wall parts 4 lie opposite one another. A spacer 7 is arranged between the inner leg 5 and outer leg 6 of each wall part 4 in the upper third of the outer leg. The spacer 7 is of the same material and made in one piece with the inner leg 5 and outer leg 6. The spacer 7 is connected to the inner leg 5 and outer leg 6 by means of a film hinge 8, so that a hinged connection results. The receptacle 3 has a rectangular cross section and consists of an injection molded plastic. The receptacle 3 can be separately mounted in a wringer device 1. The receptacle 3 is secured in wringer 1 by a press fit connection.

Figure 8:
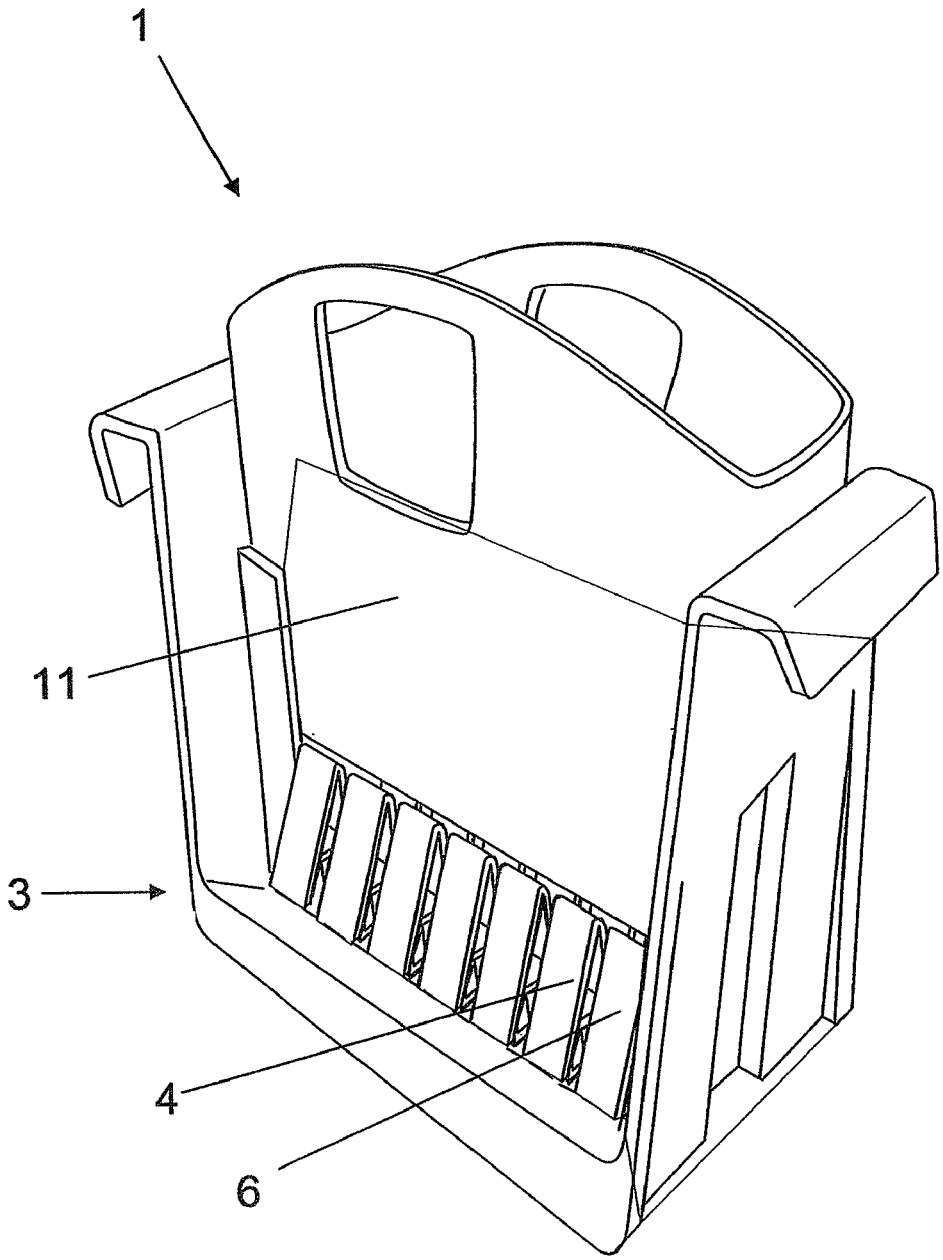
FIG. 8 is a perspective view of the wringer of FIG. 7 with an attached insertion funnel.

FIG. 8 shows a wringer 1 as in FIG. 7 in a complete perspective drawing.

The invention claimed is:

1. A wringer for a mop comprising a receptacle for wringing of the mop by inward pressure, the receptacle including a plurality of wall parts, each wall part having an inner leg and an outer leg that are connected together and at least one spacer arranged between each inner leg and each outer leg, wherein each spacer is hinged to a respective inner and outer leg.

2. The wringer of claim 1, wherein the hinged connection of the spacers to the inner legs and outer legs is via film hinges.

3. The wringer of claim 1, wherein the inner legs and the outer legs have a penetration in a transition region.

4. The wringer of claim 1, wherein each spacer is arranged in an upper third of the respective outer leg.

5. The wringer of claim 1, wherein the wall parts are substantially V-shaped.

6. The wringer of claim 1, further including a funnel mountable on the receptacle.

7. The wringer of claim 1, wherein the receptacle is a single piece that is made of a single material.

8. A new wringer for a mop comprising a receptacle for wringing of the mop by inward pressure, the receptacle including a plurality of wall parts, each wall part having an inner leg and an outer leg that are connected together and at least one spacer arranged between each inner leg and each outer leg, wherein the inner legs are connected together at their free ends.

9. The wringer of claim 8, wherein each spacer is hinged to a respective inner and outer leg.

10. The wringer of claim 8, wherein the inner and outer legs have a penetration in a transition region.

11. The wringer of claim 8, wherein the wall parts are substantially V-shaped.

12. A wringer for a mop comprising a receptacle for wringing of the mop by inward pressure, the receptacle including a plurality of wall parts, each wall part having an inner leg and an outer leg that are connected together and at least one spacer arranged between each inner leg and each outer leg, wherein at least the inner legs are made spiral shaped.

13. The wringer of claim 12, wherein each spacer is hinged to a respective inner and outer leg.

14. The wringer of claim 12, wherein the inner and outer legs have a penetration in a transition region.

15. The wringer of claim 12, wherein the wall parts are substantially V-shaped.

16. A wringer for a mop comprising a receptacle for wringing of the mop by inward pressure, the receptacle including a plurality of wall parts, each wall part having an inner leg and an outer leg that are connected together and at least one spacer arranged between each inner leg and each outer leg, wherein the receptacle includes at least eight wall parts.

17. The wringer of claim 16, wherein each spacer is hinged to a respective inner and outer leg.

18. The wringer of claim 16, wherein the inner and outer legs have a penetration in a transition region.

19. The wringer of claim 16, wherein the wall parts are substantially V-shaped.

* * * * *